US009363853B2

(12) United States Patent
Gharagozloo et al.

(10) Patent No.: US 9,363,853 B2
(45) Date of Patent: Jun. 7, 2016

(54) SYSTEM AND METHOD FOR POWERING DUAL MAGNETRONS USING A DUAL POWER SUPPLY

(71) Applicant: Heraeus Noblelight Fusion UV Inc., Gaithersburg, MD (US)

(72) Inventors: Mahmood Gharagozloo, Gaithersburg, MD (US); Ta Hai Yeh, Alexandria, VA (US); Pradyumna Kumar Swain, North Potomac, MD (US)

(73) Assignee: Heraeus Noblelight America LLC, Gaithersburg, MD (US)

( * ) Notice: Subject to any disclaimer, the term of this patent is extended or adjusted under 35 U.S.C. 154(b) by 388 days.

(21) Appl. No.: 13/954,480

(22) Filed: Jul. 30, 2013

(65) Prior Publication Data

US 2014/0263291 A1 Sep. 18, 2014

Related U.S. Application Data

(60) Provisional application No. 61/788,500, filed on Mar. 15, 2013.

(51) Int. Cl.
*H05B 6/68* (2006.01)

(52) U.S. Cl.
CPC ..... *H05B 6/68* (2013.01); *H05B 2206/044* (2013.01)

(58) Field of Classification Search
CPC ..... H05B 6/68; H05B 2206/044
USPC ..... 219/718, 719, 717, 716, 715, 702, 748, 219/760, 761; 204/192.12, 298.02, 298.03, 204/298.06, 298.08, 298.13, 298.19; 307/31
See application file for complete search history.

(56) References Cited

U.S. PATENT DOCUMENTS

| | | | | |
|---|---|---|---|---|
| 3,619,536 | A | 11/1971 | Boehm | |
| 4,868,509 | A | 9/1989 | Ury et al. | |
| 5,571,439 | A * | 11/1996 | Daley | H05B 6/683 219/716 |
| 5,838,114 | A | 11/1998 | Penzenstadler et al. | |
| 6,177,783 | B1 | 1/2001 | Donohue | |
| 6,972,079 | B2 | 12/2005 | Seymour et al. | |
| 2002/0084695 | A1 | 7/2002 | Penzenstadler et al. | |
| 2005/0218813 | A1 | 10/2005 | Shinohara | |
| 2009/0057133 | A1 | 3/2009 | Kouznetsov | |
| 2010/0140083 | A1 | 6/2010 | Tietema et al. | |
| 2010/0264893 | A1 | 10/2010 | Li | |
| 2012/0138602 | A1 * | 6/2012 | Hirano | H05B 6/687 219/719 |

FOREIGN PATENT DOCUMENTS

JP 2006092874 A * 4/2006

OTHER PUBLICATIONS

International Search Report for PCT Patent Application No. PCT/US2013/52729 mailed Jan. 3, 2014.

* cited by examiner

*Primary Examiner* — Quang Van
(74) *Attorney, Agent, or Firm* — Lowenstein Sandler LLP

(57) ABSTRACT

A system and method for powering a dual magnetron with a dual power supply is disclosed. A first power supply supplies a first voltage to a first magnetron. A second power supply supplies a second voltage to a second magnetron. A balancer circuit controls a drive current for altering a magnetic field of the first magnetron and a magnetic field of the second magnetron to maintain the first voltage and the second voltage at a substantially equal voltage.

12 Claims, 3 Drawing Sheets

SYSTEM AND METHOD FOR POWERING DUAL MAGNETRONS USING A DUAL POWER SUPPLY

CROSS-REFERENCE TO RELATED APPLICATIONS

This application claims the benefit of U.S. provisional patent application No. 61/788,500 filed Mar. 15, 2013, the disclosure of which is incorporated herein by reference in its entirety.

FIELD OF THE INVENTION

The invention relates to a system and method for controlling a pair of magnetrons that are powered by dual power supplies operating at a common voltage.

BACKGROUND OF THE INVENTION

Magnetrons may be used to generate radio frequency (RF) energy. This RF energy may be used for different purposes, such as heating items (i.e., microwave heating), or it may be used to generate a plasma. The plasma, in turn, may be used in many different processes, such as thin film deposition, diamond deposition and semiconductor fabrication processes. The RF energy may also be used to create a plasma inside a quartz envelope that generates UV (or visible) light. Those properties decisive in this regard are the high efficiency achieved in converting d.c. (direct current) power to RF energy and the geometry of the magnetron. One drawback is that the voltage required to produce a given power output varies from magnetron to magnetron. This voltage may be determined predominantly by the internal geometry of the magnetron and the magnetic field strength in the cavity.

Some applications may require two magnetrons to provide the required RF energy. In these situations, an individual power source has been required for each magnetron. However, two magnetrons of identical design may not have identical voltage versus current characteristics. Normal manufacturing tolerance and temperature differences between two identical magnetrons may yield different voltage versus current characteristics from unit to unit and are subject to change under dynamic operating conditions of their life cycle. As such, each magnetron may have a slightly different voltage. For example, the magnetrons may have mutually different operating curves such that one magnetron may produce a higher power output than the other magnetron. The magnetron having the higher output power may become hotter than the other, resulting in a shorter useful lifespan than the other. In addition, this may cause the power output of the magnetron producing the higher output to render the plasma in its half of the bulb to become hotter than the other, thereby producing an asymmetrical UV output power pattern.

Accordingly, what would be desirable, but has not yet been provided, is a system and method for maintaining a constant voltage and current operating point of a dual power supply for powering dual magnetrons.

SUMMARY OF THE INVENTION

The above-described problems are addressed and a technical solution is achieved in the art by providing a system and method for powering a dual magnetron with a dual power supply. A first power supply supplies a first voltage to a first magnetron. A second power supply supplies a second voltage to a second magnetron. A balancer circuit controls a drive current for altering a magnetic field of the first magnetron and a magnetic field of the second magnetron to maintain the first voltage and the second voltage at a substantially equal voltage. The first voltage and the second voltage may be a substantially constant voltage.

In an embodiment, the first power supply provides a first supply current to the first magnetron and the second power supply provides a second supply current substantially equal to the first supply current to the second magnetron to maintain a substantially common operating point between the first magnetron and the second magnetron.

In an embodiment, the system may further comprise a first coil driver electrically coupled to the balancer circuit and magnetically coupled to the first magnetron and a second coil driver electrically coupled to the first coil driver and magnetically coupled to the second magnetron. The first coil driver and the second coil driver may be electrically coupled in series.

The first coil driver and the second coil driver may receive the drive current. The drive current energizes the first coil driver and the drive current energizes the second coil driver to adjust the magnetic field of the first magnetron and the magnetic field of the second magnetron in opposite directions, respectively, to maintain the first voltage and the second voltage at the substantially equal voltage.

In an embodiment, the balancer circuit may further comprise an auxiliary power supply for supplying the drive current. The balancer circuit may further comprise a processing device in signal communication with the first power supply for sensing the first voltage and in signal communication with the second power supply for sensing the second voltage. The processing device may be a digital signal processor. The processing device may supply an error signal to the auxiliary power supply to adjust the drive current. The error signal supplied to the auxiliary power supply may be based on an output of a proportional-integral-derivative (PID) feedback loop or a proportional-integral (PI) servo-loop implemented by the processing device.

In an embodiment, the processing device may sense a difference in magnitude of voltage between the first voltage and the second voltage.

In an embodiment, the drive current may have a polarity corresponding to a polarity of the difference in magnitude between the first voltage and the second voltage. A magntiude of the drive current may further be based on an instantaneous voltage difference between the first voltage and the second voltage and a rate of convergence between the first voltage and the second voltage.

BRIEF DESCRIPTION OF THE DRAWINGS

The invention may be more readily understood from the detailed description of an exemplary embodiment presented below considered in conjunction with the attached drawings and in which like reference numerals refer to similar elements and in which.

It is to be understood that the attached drawings are for purposes of illustrating the concepts of the invention and may not be to scale.

DETAILED DESCRIPTION OF THE INVENTION

Figure 1:
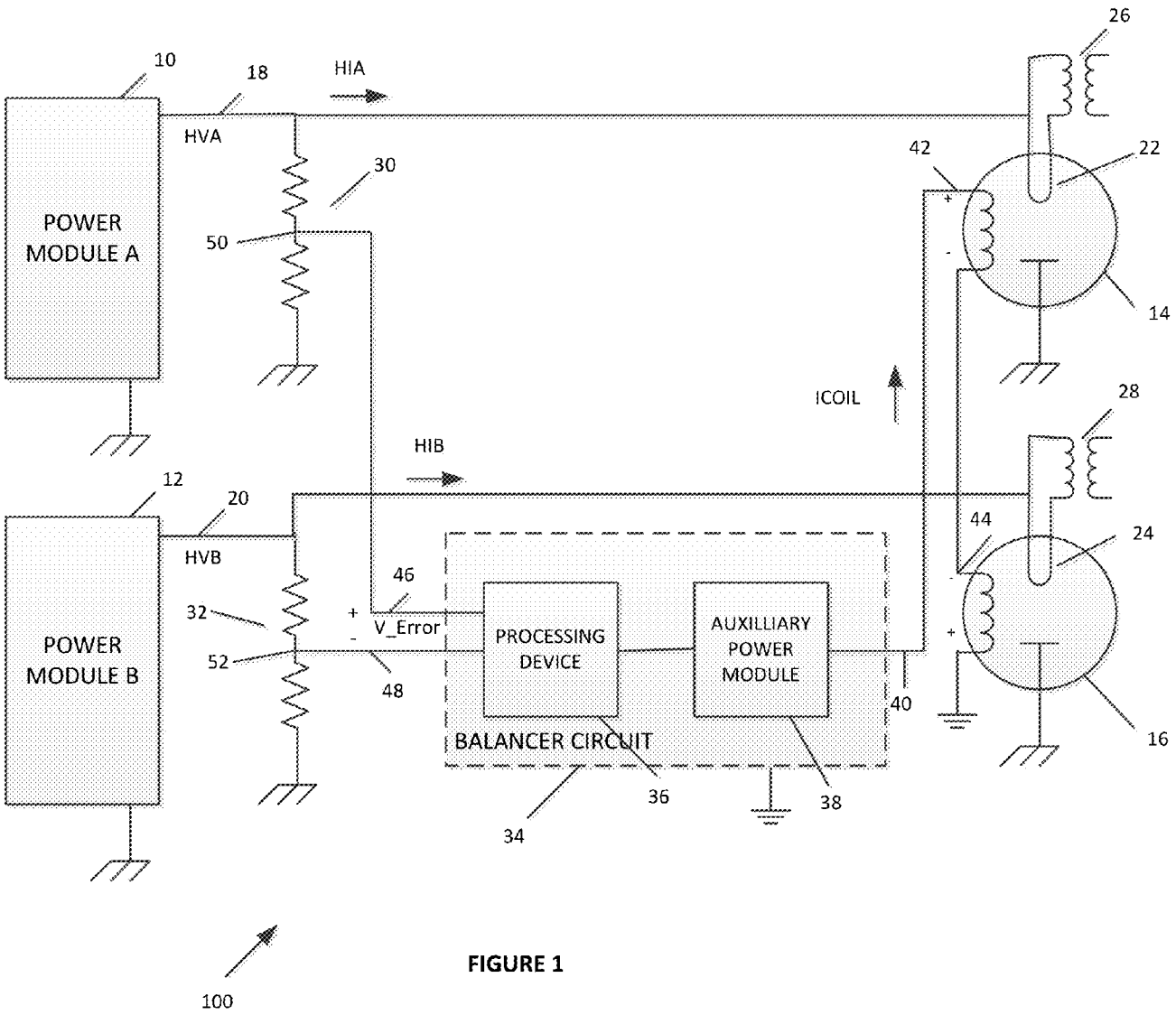
FIG. 1 is a circuit diagram of one embodiment of a system for powering two magnetrons from a dual power supply.

FIG. 1 is a circuit diagram of one embodiment of a system 100 for powering two magnetrons from a dual power supply. In particular, FIG. 1 shows a power supply 10 and a power supply 12, such as a pair of high-voltage low ripple d.c. power modules. For example, the power supplies 10, 12 may each include a solid state high voltage power module capable of 0.84 amp output at 4.5 KV. The power supplies 10, 12 may be designed to provide a constant current output (or approximately constant current). Other amounts of current and power are also within the scope of the invention. The power supplies 10, 12 may be coupled to corresponding cathodes of magnetrons 14, 16 along corresponding high potential lines 18, 20. In an embodiment, corresponding filaments 22, 24 of the magnetrons 14, 16 may be coupled to corresponding filament transformers 26, 28 that provide the necessary current for filament heating. The primaries of the filament transformers 26, 28 may be powered from an AC (alternating current) source (such as 100 to 200 volts). The cathode terminal may also be shared with one of the filament terminals.

The high potential lines 18, 20 provide power supply signal voltages, HVA and HVB, respectively, to be sensed and adjusted according to an embodiment. The power supply output voltages, HVA and HVB, are sensed by corresponding voltage dividers 30, 32 that each provide reduced output voltages on signal lines 50, 52 proportional to the power supply signal voltages, HVA and HVB. The reduced output voltages on signal lines 50, 52 are provided as inputs to a balancer circuit 34.

In one embodiment, the balancer circuit 34 may comprise a processing device 36. In one embodiment, the processing device 36 may be a digital signal processor. The processing device 36 is coupled to an auxiliary power module 38. An output signal line 40 is configured to provide a coil drive current, ICOIL, to a pair of series connected coil drivers 42, 44 each magnetically coupled to corresponding magnetrons 14, 16. The windings of the coil drivers 42, 44 are driven in opposite directions to provide opposing magnetic fields to the magnetrons 14, 16 to reduce a difference in the power supply output voltages, HVA and HVB, on the high potential lines 18, 20 of the power supplies 10, 12 to a substantially equal voltage. In one embodiment, the power supply output voltages, HVA and HVB, may be substantially constant.

In FIG. 1, the balancer circuit 34 may be utilized to adjust the voltage in the magnetrons 14, 16. More specifically, the balancer circuit 34 is configured to control a coil drive current, ICOIL, supplied to the coil driver 42 associated with the first magnetron 14 and the coil drive current, ICOIL, supplied to the coil driver 44 associated with the second magnetron 16. The coil drive current, ICOIL, has the effect of altering a magnetic field of the first magnetron 14 and a magnetic field of the second magnetron 16 to maintain the power supply output voltages, HVA and HVB, of the power supplies 10, 12 on the high potential lines 18, 20 at a substantially equal voltage.

In an embodiment, the balancer circuit 34 may be further configured to maintain the signal voltages, HVA and HVB, at a substantially constant voltage. The balancer circuit 34 is further configured to drive the coil drivers 42, 44 with a coil drive current, ICOIL, of equal magnitude but opposite polarity when the respective coils of the coil drivers 42, 44 are would in opposite directions. As a result, a magnetic field of the first magnetron 14 and a magnetic field of the second magnetron 16 tend to oppose each other to drive any difference in voltage between the signal voltages, HVA and HVB, of the power supplies 10, 12 on the high potential lines 18, to zero. The first power supply 10 is further configured to provide a first supply current, HIA, to the first magnetron 14 and the second power supply 12 is further configured to provide a second supply current, HIB, substantially equal to the first supply current, HIA, to the second magnetron 16 to maintain a substantially common operating point (i.e., of the voltage-current characteristics) between the first magnetron 14 and the second magnetron 16.

The auxiliary power module 38 is configured to supply the coil drive current, ICOIL, under the control of the processing device 36. The processing device, in turn, is configured to sense an error signal, V_Error, on inputs 46, 48 of the balancer circuit 34 to adjust the coil drive current, ICOIL. The error signal, V_Error, is provided on output signal lines 50, 52 of voltage dividers 30, 32 to sense a difference in magnitude of voltage between the signal voltages, HVA and HVB, of the power supplies 10, 12 on the high potential lines 18, 20. The coil drive current, ICOIL, has a polarity corresponding to a polarity of the difference in magnitude between the first voltage, HVA, and the second voltage, HVB. The coil drive current magnitude and polarity are derived from the error signal, V_Error, by the balancer circuit 34 when the processing device 36 is configured to simulate a proportional-integral-derivative (PID) feedback loop or a proportional-integral (PI) servo-loop.

The magnitude and polarity of the coil drive current, ICOIL, is based on an instantaneous voltage difference between signal voltages, HVA and HVB, of the power supplies 10, 12 on the high potential lines 18, 20 and a rate of convergence between the signal voltages, HVA and HVB, of the power supplies 10, 12 on the high potential lines 18, 20.

Figure 2:
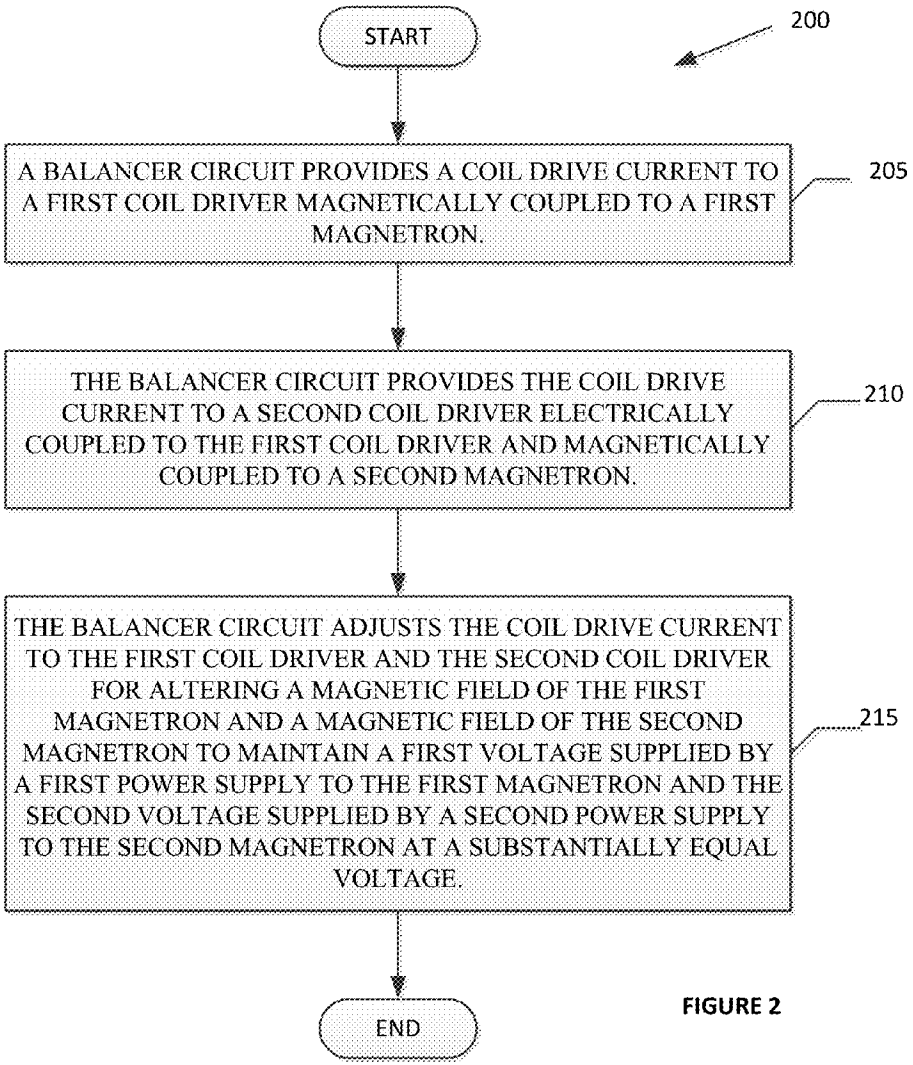
FIG. 2 is a flow diagram illustrating an example of one embodiment of a method of powering a system having a first magnetron and a second magnetron.

FIG. 2 is a flow diagram illustrating an example of one embodiment of a method 200 of powering a system having a first magnetron 14 and a second magnetron 16. At block 205, a balancer circuit 36 provides a coil drive current, ICOIL, to a first coil driver 42 magnetically coupled to a first magnetron 14. At block 210, the balancer circuit 34 provides the coil drive current, ICOIL, to a second coil driver 44 electrically coupled to the first coil driver 42 and magnetically coupled to the second magnetron 16. At block 215, the balancer circuit 34 adjusts the coil drive current, ICOIL, to the first coil driver 42 and the second coil driver 44 for altering a magnetic field of the first magnetron 14 and a magnetic field of the second magnetron 16 to maintain a first voltage, HVA, supplied by a first power supply 10 to the first magnetron 14 and the second voltage, HVB supplied by a second power supply 12 to the second magnetron 16 at a substantially equal voltage. Substantially equal is defined to be a difference in voltage between the first voltage, HVA, and the second voltage, HVB, of about ±10 volts or less.

The substantially equal voltage may be a substantially constant voltage. The coil drive current, ICOIL, may energize the first coil driver 42 and the coil drive current, ICOIL, may energizes the second coil driver 44 to adjust the magnetic field of the first magnetron 14 and the magnetic field of the second magnetron 16 in opposite directions, respectively, to maintain the first voltage, VHA, and the second voltage, VHB, at the substantially equal voltage.

The coil drive current, ICOIL, supplied to the first magnetron 14 and the second magnetron 16 may be of the same magnitude but of opposite polarity. The first power supply 10 may be further configured to provide a first supply current, HIA, to the first magnetron 14 and the second power supply 12 may be further configured to provide a second supply current, HIB, substantially equal to the first supply current, HIA, to the second magnetron 16 to maintain a substantially common operating point between the first magnetron 14 and the second magnetron 16.

The coil drive current, ICOIL, supplied by the balancer circuit 34 may be adjusted based on an error signal, V_error, based on, for example, sensing a difference in magnitude of voltage between the first voltage supplied, HVA, by the first power supply 10 to the first magnetron 14 and a second voltage supplied, HVB, by the second power supply 12 to the second magnetron 16. In one embodiment, the balancer circuit 34 may adjust the coil drive current, ICOIL, based on determining an instantaneous voltage difference between the first voltage, HVA, and the second voltage, HVB, and a rate of convergence between the first voltage, HVA, and the second voltage, HVB.

More particularly, in one embodiment, software control to operate the processing device 36 of the system 100 of FIG. 1 may employ a drive subroutine to continuously sample the operating anode voltages applied to the two magnetrons, HVA, and HVB, respectively. The drive subroutine may operate the processing device 36 to furnish an appropriate amount of coil drive current, ICOIL, to the coil drives 42, 44 in a specific direction to achieve a balance of the two voltages HVA, and HVB, at substantially all times and under substantially all operating conditions.

At system startup, the two magnetron voltages, HVA and HVB, may be sampled. When the two magnetron voltages, HVA and HVB, have reached their respective peak operating level to within less than a peak voltage magnitude of variation over a certain number of the most recent sampling periods (e.g., 100V (volts) of variation in the last 5 sampling periods), then the balancing current routine begins. A difference in monitored magnetron voltage, V_error, is calculated. The output current, ICOIL, of the auxiliary power module 38, is controlled with a command from the processing device 36 to alter the magnitude of current in a range of from 0 A (amps) to ±3 A. The current amplitude and polarity of auxiliary power module 38, is adjusted under program control to balance the two voltages, HVA and HVB. The polarity of the current amplitude of the auxiliary power module 38 may be positive for a positive difference in voltages of V_error and vice versa, as monitored.

The appropriate amount of current to be supplied to the coil drivers 42, 44 at any instant during the balancing process depends on both the instantaneous voltage difference, V_error, and the rate of convergence between the two voltages, HVA and HVB. It should be provided at levels such that the difference diminishes to zero in a controlled manner with the least amount of oscillations. This is accomplished by commonly known feedback control techniques, such as proportional-integral-derivative (PID) feedback or proportional-integral (PI) feedback. In one example, a settling time to 1% differential of the mean of the two voltages should be targeted, e.g., 100 msec. In an example, a balancing accuracy of voltage differential between the two magnetrons 14, 16, should be maintained at 10V or less.

The process may be repeated continuously on a real-time basis with updated voltage difference values and corresponding drive currents in an ongoing nested loop to maintain balance between the two magnetrons during the entire period of active operation, including warm-up, stabilization, and dynamic response to operational changes.

Figure 3:
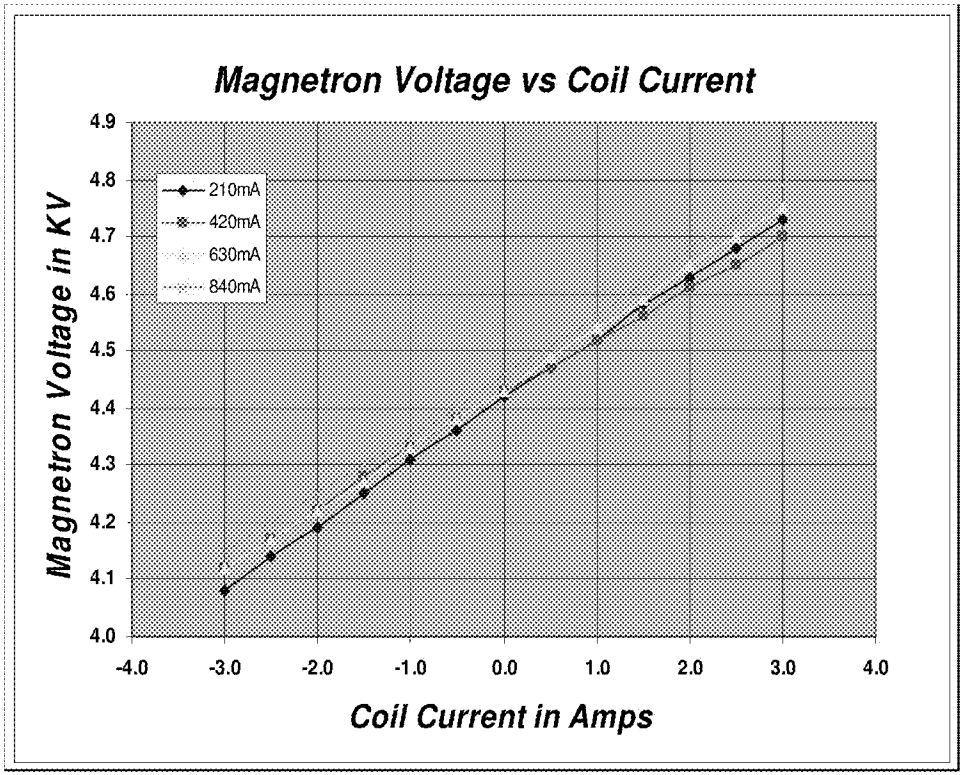
FIG. 3 is a graph illustrating a conventional magnetron voltage vs. coil current.

The approximate amount of the required steady state coil drive current has been established for various voltage differentials between the magnetrons 14, 16 and is discussed hereinbelow. FIG. 3 is a graph illustrating a conventional magnetron voltage vs. coil current. In the graph, the operating anode voltage is approximately 4.45 kV at 840 mA with no coil drive. The magnetron voltage may change with different magnetron current levels. Other magnetrons may operate at somewhat different voltages.

The gain of voltage vs. coil current is approximately 100V/A, varying somewhat with manufacturing tolerances of a magnetron. Since the two drive coils 42, 44 are driven with the same current but in opposite directions, then, according to FIG. 3, a 1 A drive coil current may bring two magnetrons with a 200 V differential of voltage of operation to the same operating voltage. The smaller the differential, the smaller the amount of current that is required to bring the magnetron operating voltage HVA and HVB to within an acceptable tolerance. The magnitude and polarity of the required coil drive current may change from one operating point to another, since operating temperature changes over time or operating parameters vary over time, depending on the current states of the V-I characteristic curves of the two magnetrons 14, 16.

Control speed and the transient response of a servo loop subroutine implemented within the processing device 36 may be optimized with empirical testing. A selected initial coil drive current, ICOIL, can be programmed into the processing device 36. Convergence may be achieved on a real-time basis by means of incremental changes in current amplitude to a final value corresponding to the initial voltage differential between the pair of magnetrons 14, 16 in operation when no coil drive current is applied. A lookup table may be employed to select a starting drive coil current for a given voltage difference, V_error. This lookup table may be employed only as a point of reference, because the table may vary to some degree with magnetron operating parameters and their variation over lifetime usage. The final DC current value may be reached when the magnetron voltage difference monitored becomes zero. The amount of incremental change in coil drive current to be programmed may correspond to a given rate of convergence that determines the settling speed and transient response of the coil drive current. This may be optimized empirically.

After a certain amount of nominal drive current is determined to bring about a balance between two magnetrons to a certain point of operation, the subroutine may continue to monitor updated voltages and to calculate a new error voltage, V_error. V_error may be employed to further correct the coil drive current for any new changes in V_error that arises with varying operating conditions. For instance, a magnetron voltage differential may reappear as the magnetrons warm up. Another example is when the operating magnetron current level is varied by a user where a magnetron voltage difference may appear. The coil drive current may then be readjusted accordingly to restore balance after the change.

In an example, input voltages VHA and VHB for a pair of magnitrons 14, 16 may be monitored. The routine waits a period of time until full operating voltages VHA and VHB are established (e.g., within a tolerance of each other) up to a maximum of a time period (e.g., 60 seconds). If the voltages VHA and VHB are still not stable, then the balancing calculation nevertheless is initiated. The difference in voltage between the two magnetrons 14, 16, V_error may then be calculated as:

$$V_error=\{HVA(Vout_DC,\text{Engine 'A'})\}-\{HVB(Vout_DC,\text{Engine 'B'})\}$$

Approximately for every 200 V of "V_error", a balancer coil drive current (IOUT_BALANCER) may be set to about +1 A or −1 A (signed value). To adjust V_error downward in absolute value, the following calculations may be performed:

$$\text{Current required to Balance}=1000\text{ mA}/200\text{V}=5\text{ mA/V}$$

$$V_\text{error Error Proportion } (V_\text{Error}_P)=(V_\text{error}/8)$$

$$\text{Output current New Calculation } (I_\text{Out}_\text{New})=(V_\text{Error}_P)\times 5\text{ mA/V}$$

The final output current to write to the processing device 36:

$$IOUT_BALANCER=(I_Out_Old)+(I_Out_New)$$

After each final calculation of "IOUT_BALANCER", it may be saved as the I_Out_Old for the next calculation.

It is to be understood that the exemplary embodiments are merely illustrative of the invention and that many variations of the above-described embodiments may be devised by one skilled in the art without departing from the scope of the invention. It is therefore intended that all such variations be included within the scope of the following claims and their equivalents.

What is claimed is:

1. A system comprising:

a first power supply to supply a first voltage;

a second power supply to supply a second voltage;

a first magnetron to be powered by the first power supply;

a second magnetron to be powered by the second power supply;

a balancer circuit to control a drive current for altering a magnetic field of the first magnetron and a magnetic field of the second magnetron to maintain the first voltage and the second voltage at a substantially equal voltage;

a first coil driver electrically coupled to the balancer circuit and magnetically coupled to the first magnetron; and a second coil driver electrically coupled to the first coil driver and magnetically coupled to the second magnetron, wherein the first coil driver and the second coil driver receive the drive current, and wherein the first coil driver and the second coil driver are electrically coupled in series.

2. The system of claim 1, wherein the first voltage and the second voltage each comprise a substantially constant voltage.

3. The system of claim 1, wherein the first power supply is further to provide a first supply current to the first magnetron and the second power supply is further to provide a second supply current substantially equal to the first supply current to the second magnetron to maintain a substantially common operating point between the first magnetron and the second magnetron.

4. The system of claim 1, wherein the drive current energizes the first coil driver and the drive current energizes the second coil driver to adjust the magnetic field of the first magnetron and the magnetic field of the second magnetron in opposite directions, respectively, to maintain the first voltage and the second voltage at the substantially equal voltage.

5. The system of claim 1, wherein the balancer circuit further comprises an auxiliary power supply for supplying the drive current.

6. The system of claim 5, further comprising a processing device in signal communication with the first power supply for sensing the first voltage and in signal communication with the second power supply for sensing the second voltage.

7. The system of claim 6, wherein the processing device comprises a digital signal processor.

8. The system of claim 6, wherein the processing device supplies an error signal to the auxiliary power supply to adjust the drive current.

9. The system of claim 8, wherein the error signal supplied to the auxiliary power supply is based on an output of a proportional-integral-derivative (PID) feedback loop or a proportional-integral (PI) servo-loop implemented by the processing device.

10. The system of claim 6, wherein the processing device senses a difference in magnitude of voltage between the first voltage and the second voltage.

11. The system of claim 10, wherein the drive current comprises a polarity corresponding to a polarity of the difference in magnitude between the first voltage and the second voltage.

12. The system of claim 6, wherein a magnitude of the drive current is based on an instantaneous voltage difference between the first voltage and the second voltage and a rate of convergence between the first voltage and the second voltage.

* * * * *